US005806324A

United States Patent [19]

Shaw

[11] Patent Number: 5,806,324

[45] Date of Patent: Sep. 15, 1998

[54] VARIABLE CAPACITY VAPOR COMPRESSION COOLING SYSTEM

[76] Inventor: David N. Shaw, 200 D Brittany Farms Rd., New Britain, Conn. 06053

[21] Appl. No.: 550,254

[22] Filed: Oct. 30, 1995

[51] Int. Cl.[6] ..... F25D 17/02; F25B 41/00

[52] U.S. Cl. ..... 62/99; 62/197; 62/201

[58] Field of Search ..... 62/197, 513, 201, 62/99

[56] References Cited

U.S. PATENT DOCUMENTS

| | | | |
|---|---|---|---|
| 4,248,055 | 2/1981 | Day et al. | 62/201 |
| 4,497,185 | 2/1985 | Shaw | 62/468 |
| 4,512,302 | 4/1985 | Bunce | 123/238 |
| 4,748,831 | 6/1988 | Shaw | 62/505 |
| 4,811,568 | 3/1989 | Horan et al. | 62/513 X |
| 5,062,274 | 11/1991 | Shaw | 62/197 X |
| 5,465,587 | 11/1995 | Sjoholm et al. | 62/197 X |
| 5,653,585 | 8/1997 | Fresco | 418/100 |

FOREIGN PATENT DOCUMENTS 452760 8/1936 United Kingdom .

OTHER PUBLICATIONS

Socio–Tech, Mitsubishi –Melco Water Cooled Large Screw Chilling Unit.

Hitachi–SRM Refrigerating Semi–Hermetic Screw Compressors.

*Primary Examiner*—William E. Wayner

*Attorney, Agent, or Firm*—Fishman, Dionne, Cantor & Colburn

[57] ABSTRACT

A variable capacity vapor compression cooling system is presented. In the system of the present invention, air conditioning requirements are entered into a microprocessor which controls the system. Liquid phase refrigerant entering an evaporator is regulated by a microprocessor controlled electronic expansion valve. Evaporated refrigerant is delivered to a pair of compressors from the evaporator. The motors for the compressors are controlled by a controller. Each of the compressors has a feed back loop attached thereto for feeding back some of the inducted vapor phase refrigerant. The amount of vapor fed back in each loop is regulated by a corresponding microprocessor controlled multi-purpose valve. The compressed vapor phase refrigerant is then presented to a condenser which condenses the refrigerant to the liquid phase which is used for cooling, as is well known in the art. Thereafter, liquid phase refrigerant is presented to an economizer where vapor phase refrigerant (i.e., flash gas) is drawn off. The amount of vapor phase refrigerant drawn off is regulated by a microprocessor controlled electronic expansion valve. This vapor phase refrigerant is presented to the multi-purpose valves where it is directed to the respective compressors. The liquid phase refrigerant is delivered to the evaporator with the flow thereof being regulated by a microprocessor controlled electronic expansion valve. Accordingly, the above describes a complete cycle which can be capacity varied without unloading of the compressors, as described more completely below. It is an important feature of the system of the present invention that capacity is varied without unloading the compressors.

36 Claims, 2 Drawing Sheets

VARIABLE CAPACITY VAPOR COMPRESSION COOLING SYSTEM

BACKGROUND OF THE INVENTION

The present invention relates generally to systems for cooling. More specifically, the present invention relates to a variable capacity vapor compression cooling system.

Cooling systems in the HVAC (heating, ventilation and air conditioning) industry are well known. By way of example, a schematic diagram of a typical cooling system is shown in FIG. 1 herein, labeled prior art. Referring to FIG. 1 herein, water enters an evaporator 12 through an input 14 where it is circulated through tubes within the evaporator and exits through an output 16. Liquid phase refrigerant enters evaporator 12 at an input 20 and evaporated refrigerant is delivered to a compressor 22 (e.g., a helical twin screw type compressor, which are well known in the art). Compressed vapor phase refrigerant is passed through an oil separator 24 for removing oil picked up in compressor 22. Thereafter the compressed vapor phase refrigerant is presented to a water cooled condenser 26 to condense the refrigerant to the liquid phase which is used for cooling, as is well known in the art. It will also be appreciated that air cooled condensers are well known and such could be used in place of the aforementioned water cooled condenser. Thereafter, liquid phase refrigerant is presented to an economizer 28 where vapor phase refrigerant (it is well known that a small portion of the refrigerant will be vapor, i.e., flash gas) is drawn off and delivered directly to the compressor. The liquid phase refrigerant is presented to input 20 of evaporator 12, thereby completing the cycle. When capacity of such a system is to be varied, it is common to unload the compressor, however, this is both inefficient and invariably, seriously complicates the overall design/cost of the compressor.

SUMMARY OF THE INVENTION

The above-discussed and other drawbacks and deficiencies of the prior art are overcome or alleviated by the variable capacity vapor compression cooling system of the present invention. In accordance with the present invention, air conditioning requirements are entered into a microprocessor which controls the system. Water enters an evaporator through an input where it is circulated through tubes within the evaporator and exits through an output. The entering water temperature is measured and presented to the microprocessor. The exiting or leaving water temperature is measured and presented to the microprocessor. The temperature of the water is regulated by the microprocessor. The regulation of the water temperature allows control of the rate of evaporation of the liquid phase refrigerant in the evaporator. Liquid phase refrigerant entering the evaporator is regulated by a microprocessor controlled electronic expansion valve. Evaporated refrigerant (i.e., vapor phase refrigerant) is delivered to forty and eighty ton compressors from the evaporator. This vapor phase refrigerant is inducted (drawn) into the suction side of the compressors. The motors for the compressors are controlled by a controller. Each of the compressors has a feed back loop attached thereto for feeding back some of the inducted vapor phase refrigerant. The amount of vapor fed back in each loop is regulated by a corresponding microprocessor controlled multi-purpose valve. The compressed vapor phase refrigerant is then presented to an air cooled condenser which condenses the refrigerant to the liquid phase which is used for cooling, as is well known in the art. Thereafter, liquid phase refrigerant is presented to an economizer where vapor phase refrigerant (i.e., flash gas) is drawn off. The amount of vapor phase refrigerant drawn off is regulated by a microprocessor controlled electronic expansion valve. This vapor phase refrigerant is presented to the multi-purpose valves where it is directed to the respective compressors. The liquid phase refrigerant is delivered to the evaporator with the flow thereof being regulated by a microprocessor controlled electronic expansion valve. Accordingly, the above describes a complete cycle which can be capacity varied without unloading of the compressors, as described more completely below. It is an important feature of the system of the present invention that capacity is varied without unloading the compressors.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
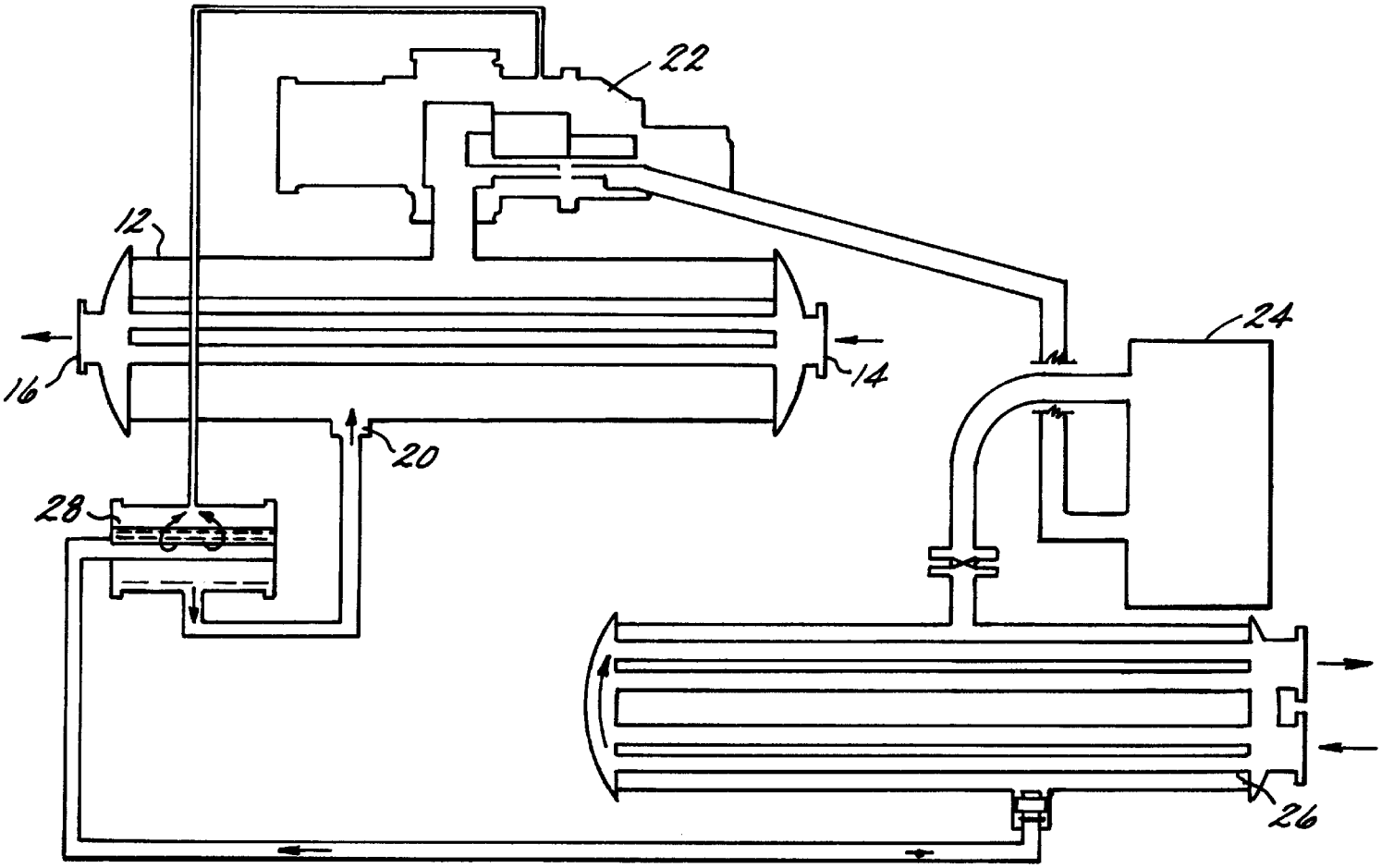
FIG. 1 (PRIOR ART)
FIG. 1 a schematic diagram a vapor compression cooling system in accordance with the prior art.
Figure 2:
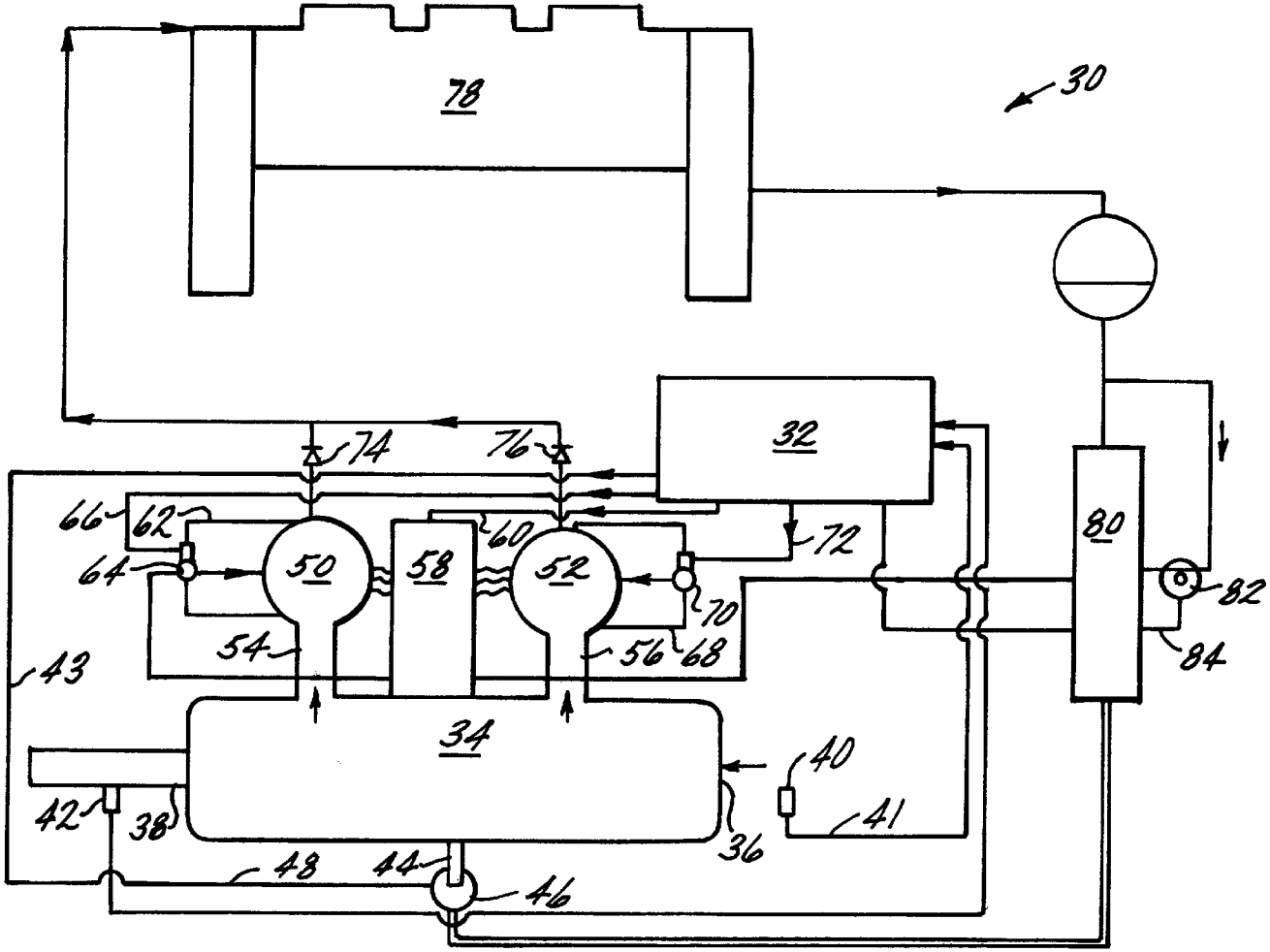
FIG. 2 is a schematic diagram of a variable capacity vapor compression cooling system in accordance with the present invention.

Referring to FIG. 2, a schematic diagram of a variable capacity vapor compression cooling system is generally shown at 30. In this example, air conditioning requirements are entered into a microprocessor 32 which controls system 30, as described below. Water enters an evaporator 34 through an input 36 where it is circulated through tubes within the evaporator and exits through an output 38. As in the prior art, when water temperature rises system capacity is increased and when water temperature drops system capacity is decreased. The entering water temperature is measured by a thermocouple 40 which sends a signal indicative of the entering water temperature to microprocessor 32, via a line 41. The exiting or leaving water temperature is measured by a thermocouple 42 which sends a signal indicative of the exiting water temperature to microprocessor 32, via a line 43. Although not shown the temperature of the water is regulated, with the temperature of the water being controlled by microprocessor 32 in response to the measured temperatures. The regulation of the water temperature allows control of the rate of evaporation of the liquid phase refrigerant in evaporator 34. Liquid phase refrigerant enters evaporator 34 at an input 44, with the rate of flow into evaporator 34 controlled by an electronic expansion valve 46, which is itself controlled by microprocessor 32 via a line 48. Evaporated refrigerant (i.e., vapor phase refrigerant) is delivered to first and second compressors 50 and 52, respectively, through outputs 54 and 56 of evaporator 34. This vapor phase refrigerant is inducted (drawn) into the section side of the compressors. In this example, compressor 50 has a forty ton capacity and compressor 52 has an eighty ton capacity. It will be appreciated that any suitable type of compressor may be employed and that system 30, e.g., a twin screw type compressor, a single screw type compressor or a multi-rotor compressor as described in copending U.S. Patent application entitled Multi-Rotor Compressor, Attorney Docket No. 95-1228, filed concurrently with the present application, and which is incorporated herein by reference. The motors for compressors 50 and 52 are controlled by a controller 58 which is itself controlled by microprocessor 32, via a line 60. Compressor 50 has a feed back loop 62 attached thereto for feeding back some of the inducted vapor phase refrigerant. The amount of feed back in loop 62 is regulated by a multi-purpose valve 64 which is controlled by microprocessor 32, via a line 66. Compressor 52 has a feed back loop 68 attached thereto for feeding back some of the inducted vapor phase refrigerant. The amount of feed back in loop 68 is regulated by a multi-purpose valve 70 which is controlled by microprocessor 32, via a line 72.

Check valves 74 and 76 only allow flow of compressed vapor phase refrigerant from compressors 50 and 52 and prevent backflow thereinto. The compressed vapor phase refrigerant is then presented to an air cooled condenser 78, condensing the refrigerant to the liquid phase which is used for cooling, as is well known in the art. Thereafter, liquid phase refrigerant is presented to an economizer 80 where vapor phase refrigerant (it is well known that a small portion of the refrigerant will be vapor) is drawn off. The amount of vapor phase refrigerant drawn off is regulated by an electronic expansion valve 82 which is controlled by microprocessor 32, via a line 84. This vapor phase refrigerant is presented to multi-purpose valves 64 and 70 where it is directed to the respective compressors 50 and 52. The liquid phase refrigerant is delivered to input 44 of evaporator 34 with the flow thereof being regulated by an electronic expansion valve 46. Accordingly, the above describes a complete cycle which can be capacity varied without unloading of the compressors, as described more completely below.

Multi-purpose valve (MPV) 64 directs and prohibits flow of economizer generated vapor from line 90 through the valve to line 92 into the economizer port of compressor 50. As is well known, the use of an economizer maximizes system capacity, whereby vapor phase refrigerant from the economizer is directed to the compressor. When MPV 64 is turned down to prohibit this flow, compressor 50 is isolated from the economizer. MPV 64 is further turned down to direct fluid bypass from line 92, at the economizer port of compressor 50, to line 94, the suction port of the compressor 50. This reduces system capacity as flow is drawn from the economizer port to suction. The system capacity is further reduced by further turning down MPV 64 to direct bypass from line 96, the discharge port of compressor 50, to line 94, the suction port of compressor 50 until the compressor is in effect unloaded. This position (i.e., MPV 64 fully turned down) facilitates an unloaded start of the compressor. Multi-purpose valve (MPV) 70 directs and prohibits flow of economizer generated vapor from line 90 through the valve to line 98 into the economizer port of compressor 52. Again, as is well known, the use of an economizer maximizes system capacity, whereby vapor phase refrigerant from the economizer is directed to the compressor. When MPV 70 is turned down to prohibit this flow, compressor 52 is isolated from the economizer. MPV 70 is further turned down to direct fluid bypass from line 98, at the economizer port of compressor 52 to line 100, the suction port of compressor 52. This reduces system capacity as flow is drawn from the economizer port to suction. The system capacity is further reduced by further turning claim MPV 70 to direct bypass from line 102, the discharge port of compressor 52, to line 100, the suction port of compressor 52 until the compressor is in effect unloaded. This position (i.e., MPV 70 fully turned down) facilitates an unloaded start of the compressor. Electronic expansion valve (EEV) 82 regulates the amount of vapor drawn off from the economizer whereby system capacity is reduced by restricting vapor phase refrigerant drawn off the economizer. Electronic expansion valve 46 regulates the amount of liquid phase refrigerant into the evaporator from the economizer whereby system capacity is reduced by restricting liquid phase refrigerant delivered to the evaporator. Motor controller 58 turns on and off the motors of compressors 50 and 52. The capacity of the system of the present invention can be varied as indicated in the TABLE below. The EEVs are turned down, as referred to in the TABLE below, by restricting the flow therethrough which in both cases reduces system capacity. The MPVs are turned down, as referred to in the TABLE below, to reduce system capacity as described hereinbefore. The Turndown ratio referred to in the TABLE below is a ratio of desired system capacity over total available system capacity. For example, with a desired system capacity of 20 tons and 120 tons available system capacity (40 tons and 80 tons) the turndown ratio is 0.17 ($^{20}/_{120}$=0.17).

TABLE

| Compressor being operated | Electronic expansion valve(s) turned down | Multi-purpose valve turned down | Turn-down ratio | Capacity in tons |
|---|---|---|---|---|
| Forty ton compressor 50 | EEV 82 and 46 | MPV 64 and 70 | .17 | 20 |
| Forty ton compressor 50 | EEV 82 and 46 | | .23 | 27 |
| Forty ton compressor 50 | EEV 82 | | .28 | 34 |
| Forty ton compressor 50 | | | .33 | 40 |
| Eighty ton compressor 52 | EEV 82 and 46 | MPV 64 and 70 | .33 | 40 |
| Eighty ton compressor 52 | EEV 82 and 46 | | .43 | 51 |
| Eighty ton compressor 52 | EEV 82 | | .54 | 65 |
| Eighty ton compressor 52 | | | .67 | 80 |
| Forty and eighty ton compressors 50 and 52 | EEV 82 and 46 | | .58 | 69 |
| Forty and eighty ton compressors 50 and 52 | EEV 82 | | .73 | 88 |
| Forty and eighty ton compressors 50 and 52 | | | 1.00 | 120 |

It is an important feature of the system of the present invention that capacity is varied without unloading the compressors. Further, it will be appreciated that the turndown ratio can be varied whereby different capacities can be obtained and the above TABLE is only exemplary. The microprocessor generates control signals which are presented to MPVs 64 and 70, EEVs 82 and 46, and controller 58 over the signal lines described above. These control signals are determined in response to system requirements which are processed in accordance with a schedule or algorithm stored in the microprocessor.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A variable capacity cooling system comprising:

an evaporator receptive to liquid phase refrigerant, said evaporator for evaporating the liquid phase refrigerant to provide vapor phase refrigerant;

a compressor receptive to the vapor phase refrigerant from said evaporator, said compressor for compressing the vapor phase refrigerant to provide compressed vapor phase refrigerant, said compressor having a suction port and an economizer port;

a condenser receptive to the compressed vapor phase refrigerant from said compressor, said condenser for condensing the compressed vapor phase refrigerant to provide the liquid phase refrigerant;

an economizer receptive to the liquid phase refrigerant from said condenser, said evaporator receiving the liquid phase refrigerant from said economizer, said economizer containing vapor phase refrigerant associated with the liquid phase refrigerant from said condenser; and a valve system for regulating flow of the vapor phase refrigerant from said economizer to said economizer port of said compressor, whereby actuation of said valve system varies capacity of said system.

2. The system of claim 1 further comprising:

an evaporator valve for regulating flow of the liquid phase refrigerant from said economizer to said evaporator, whereby actuation of said evaporator valve varies capacity of said system.

3. The system of claim 2 wherein said evaporator valve comprises an electronic expansion valve.

4. The system of claim 1, wherein:

said evaporator includes a tube for circulating water with the temperature of the water being circulated whereby capacity of said system is varied, said tube having a water input and a water output.

5. The system of claim 4 further comprising:

a first thermocouple for measuring the temperature of the water at said water input of said tube; and a second thermocouple for measuring the temperature of the water at said water output of said tube;

whereby measured water temperatures are used to regulate the temperature of the water circulating in said tube.

6. The system of claim 1 further comprising:

a processor for generating a control signal in response to cooling requirements, said control signal for actuating said valve system.

7. The system of claim 1 wherein said condenser comprises an air cooled condensor.

8. The system of claim 1 wherein said valve system comprises an electronic expansion valve.

9. The system of claim 1 further comprising:

a feed back loop for feeding back inducted vapor phase refrigerant to said suction port or said economizer port of said compressor; and wherein said valve system further regulates the flow of vapor phase refrigerant in said feed back loop, whereby actuation of said valve system further varies capacity of said system.

10. The system of claim 9 wherein said valve system comprises a multipurpose valve.

11. The system of claim 9 wherein said valve system comprises:

a feed back valve for regulating flow of vapor refrigerant in said feed back loop; and an economizer valve for regulating flow of the vapor phase refrigerant from said economizer to said economizer port.

12. The system of claim 11 wherein:

said feed back valve comprises a multipurpose valve; and said economizer valve comprises an electronic expansion valve.

13. A method for varying capacity of a cooling system, the method comprising the steps of:

evaporating liquid phase refrigerant in an evaporator to provide vapor phase refrigerant;

compressing the vapor phase refrigerant from said evaporator in a compressor to provide compressed vapor phase refrigerant;

condensing the compressed vapor phase refrigerant from said compressor in a condenser to provide the liquid phase refrigerant;

drawing off vapor phase refrigerant associated with the liquid phase refrigerant from said condenser in an economizer;

receiving the liquid phase refrigerant from said economizer at said evaporator; and regulating flow of the vapor phase refrigerant from said economizer to an economizer port of said compressor to vary capacity of said system.

14. The method of claim 13 further comprising the step of:

regulating flow of the liquid phase refrigerant from said economizer to said evaporator to vary capacity of said system.

15. The method of claim 13 further comprising the steps of:

feeding back inducted vapor phase refrigerant from an output of said compressor to said economizer port or a suction port of said compressor; and regulating the flow of compressed vapor phase refrigerant in said feed back loop to further vary capacity of said system.

16. The method of claim 13 further comprising the step of:

circulating water through a tube in said evaporator, said tube having a water input and a water output; and regulating the temperature of the water being circulated to vary capacity of said system.

17. The method of claim 16 further comprising the steps of:

measuring the temperature of the water at said water input of said tube;

measuring the temperature of the water at said water output of said tube; and wherein said step of regulating the temperature of the water circulating in said tube comprises regulating the water temperature in response to said measured temperatures.

18. A variable capacity cooling system comprising:

an evaporator receptive to liquid phase refrigerant, said evaporator for evaporating the liquid phase refrigerant to provide vapor phase refrigerant;

a first compressor receptive to the vapor phase refrigerant from said evaporator, said first compressor for compressing the vapor phase refrigerant to provide compressed vapor phase refrigerant, said first compressor having a suction port and an economizer port;

a second compressor receptive to the vapor phase refrigerant from said evaporator, said second compressor for compressing the vapor phase refrigerant to provide compressed vapor phase refrigerant, said second compressor having a suction port and an economizer port;

a condenser receptive to the compressed vapor phase refrigerant from said first and second compressors, said condenser for condensing the compressed vapor phase refrigerant to provide the liquid phase refrigerant;

an economizer receptive to the liquid phase refrigerant from said condenser, said evaporator receiving the liquid phase refrigerant from said economizer, said economizer containing vapor phase refrigerant associated with the liquid phase refrigerant from said condenser;

a valve system for regulating flow of the vapor phase refrigerant from said economizer to at least one of said economizer ports of first and second said compressors;

an evaporator valve for regulating flow of the liquid phase refrigerant from said economizer to said evaporator; and a processor for generating first control signals in response to cooling requirements, said first control signals for actuating said valve system and said evaporator valve to vary capacity of said system.

19. The system of claim 18 further comprising:

a first feed back loop for feeding back inducted vapor phase refrigerant to said economizer port or said suction port of said first compressor;

said valve system further regulates the flow of vapor phase refrigerant in said first feed back loop;

a second feed back loop for feeding back inducted vapor phase refrigerant to said economizer port or said suction port of said second compressor; and said valve system further regulates the flow of vapor phase refrigerant in said second feed back loop;

wherein said processor generates second control signals in response to cooling requirements, said second control signals for actuating said valve system to further vary capacity of said system.

20. The system of claim 19 wherein said valve system comprises multi-purpose valves.

21. The system of claim 19 wherein said valve system comprises:

a first feed back valve for regulating flow of vapor refrigerant in said first feed back loop;

a second feed back valve for regulating flow of vapor refrigerant in said second feed back loop; and an economizer valve for regulating flow of the vapor phase refrigerant from said economizer to said economizer port.

22. The system of claim 21 wherein:

said first and said second feed back valves comprise multipurpose valves; and said economizer valve comprises an electronic expansion valve.

23. The system of claim 18 wherein:

said evaporator includes a tube for circulating water with the temperature of the water being circulated whereby capacity of said system is varied, said tube having a water input and a water output.

24. The system of claim 23 further comprising:

a first thermocouple for measuring the temperature of the water at said water input of said tube; and a second thermocouple for measuring the temperature of the water at said water output of said tube;

whereby measured water temperatures are used to regulate the temperature of the water circulating in said tube.

25. The system of claim 18 wherein said condenser comprises an air cooled condenser.

26. The system of claim 18 wherein:

said valve system and said evaporator valve comprise electronic expansion valves.

27. A variable capacity cooling system comprising:

an evaporator receptive to liquid phase refrigerant, said evaporator for evaporating the liquid phase refrigerant to provide vapor phase refrigerant;

a compressor receptive to the vapor phase refrigerant from said evaporator, said compressor for compressing the vapor phase refrigerant to provide compressed vapor phase refrigerant, said compressor having a suction port and an economizer port;

a condenser receptive to the compressed vapor phase refrigerant from said compressor, said condenser for condensing the compressed vapor phase refrigerant to provide the liquid phase refrigerant;

an economizer receptive to the liquid phase refrigerant from said condenser, said evaporator receiving the liquid phase refrigerant from said economizer, said economizer containing vapor phase refrigerant associated with the liquid phase refrigerant from said condenser;

an evaporator valve for regulating flow of the liquid phase refrigerant from said economizer to said evaporator, whereby actuation of said evaporator valve varies capacity of said system.

28. The system of claim 27 further comprising:

a feed back loop for feeding back inducted vapor phase refrigerant to said suction port or said economizer port of said compressor;

a valve system for regulating flow of the vapor phase refrigerant from said feed back loop to said economizer port of said compressor; and said valve system further regulates the flow of vapor phase refrigerant in said feed back loop, whereby actuation of said valve system further varies capacity of said system.

29. The system of claim 28 wherein said valve system comprises a multipurpose valve.

30. The system of claim 28 wherein said valve system comprises:

a feed back valve for regulating flow of vapor refrigerant in said feed back loop; and an economizer valve for regulating flow of the vapor phase refrigerant from said economizer to said economizer port.

31. The system of claim 30 wherein:

said feed back valve comprises a multipurpose valve; and said economizer valve comprises an electronic expansion valve.

32. The system of claim 27 wherein:

said evaporator includes a tube for circulating water with the temperature of the water being circulated whereby capacity of said system is varied, said tube having a water input and a water output.

33. The system of claim 32 further comprising:

a first thermocouple for measuring the temperature of the water at said water input of said tube; and a second thermocouple for measuring the temperature of the water at said water output of said tube;

whereby measured water temperatures are used to regulate the temperature of the water circulating in said tube.

34. The system of claim 27 further comprising:

a processor for generating a control signal in response to cooling requirements, said control signal for actuating said valve system.

35. The system of claim 27 wherein said condenser comprises an air cooled condensor.

36. The system of claim 27 wherein said evaporator valve comprises an electronic expansion valve.

* * * * *

UNITED STATES PATENT AND TRADEMARK OFFICE

CERTIFICATE OF CORRECTION

PATENT NO. : 5,806,324
DATED : September 15, 1998
INVENTOR(S) : David N. Shaw

It is certified that error appears in the above-identified patent and that said Letters Patent is hereby corrected as shown below:

Column 2,
Line 23, after "1" insert -- is --.
Line 23, after "diagram" insert -- of --
Line 59, delete "section" and insert therefor -- suction --

Column 3,
Line 62, after "turning" delete "claim"

Signed and Sealed this

Thirty-first Day of July, 2001

*Attest:*

Nicholas P. Godici

*Attesting Officer*

NICHOLAS P. GODICI
*Acting Director of the United States Patent and Trademark Office*